United States Patent [19]

Wickstrom et al.

[11] 4,192,107

[45] Mar. 11, 1980

[54] CONICAL ROOF STRUCTURE

[75] Inventors: Lawrence L. Wickstrom; Jock C. Garden, both of Hutchinson, Kans.

[73] Assignee: Farmland Industries, Inc., Kansas City, Mo.

[21] Appl. No.: 910,873

[22] Filed: May 30, 1978

[51] Int. Cl.[2] ..... E04B 7/00

[52] U.S. Cl. ..... 52/82; 52/225

[58] Field of Search ..... 52/82, 225, 245, 192; 34/174, 233, 52; 98/54, 55

[56] References Cited

U.S. PATENT DOCUMENTS

| | | | |
|---|---|---|---|
| 1,852,659 | 4/1932 | Kramer | 52/82 |
| 3,583,112 | 6/1971 | Kennedy | 52/82 |
| 4,035,928 | 7/1977 | Sietmann | 52/82 |

*Primary Examiner*—J. Karl Bell

*Attorney, Agent, or Firm*—Edward L. Brown, Jr.

[57] ABSTRACT

A conically-shaped roof structure comprising a plurality of radially spaced tapered roof panels with the ribbed edges of each panel lying in overlapping relation. Anchored to the undersurface of the roof panel ribs are a plurality of stiffener members having a vertically extending web for vertical loads and a horizontally extending lower flange for lateral loading and cable suspension means attached to the opposite ends of the stiffener member joining at a center point for supporting vertical thermocouple cables.

11 Claims, 5 Drawing Figures

CONICAL ROOF STRUCTURE

BACKGROUND OF THE INVENTION

1. Field of the Invention

Grain bin roofs are often required to support loads from thermocouple cables which hang down from the roof at various locations and heights in the bin to sense hot spots in the grain being stored. These cables are not hung from the center of the bin but rather at various locations between the bin wall and the center of the roof cone, and at varying heights in the bin. The pressure caused by the grain flowing from the bin is transmitted to the thermocouple cables extending down in the grain, as the grain moves downward in the bin. Conventional grain bin roofs could not support loads of this nature and therefore additional structure has to be added.

2. Description of the Prior Art

The prior art methods of supporting thermocouple cables has included various heavy beams and truss structures fastened to the center cone of the roof and to vertical columns around the grain bin walls. Since these loadings on the cables can be substantial, the beams and truss structures have been heavy and very difficult to install.

SUMMARY OF THE INVENTION

The present invention involves a cable suspension system whereby a pair of suspension cables are attached to opposite ends of a roof mounted stiffener member converging together at a load mounting point for support of the thermocouple cable. Under the load, the angled pair of suspension cables are in tension while the roof mounted stiffener is under a compressive load. Since the upper flange of the stiffener is anchored into the two adjacent roof panels, the moment of inertia in a horizontal plane of the combined structure is sufficient to carry substantial loads even though the span length is substantial.

Therefore, it is the principal object of the present invention to provide a suspension cable load support system in a grain bin roof which utilizes the combined structural strength of stiffeners and the roof panels.

Another object of the present invention is to provide a grain bin roof structure capable of supporting substantial loads at varying points across the roof with a lightweight simplified support structure which is integral with the roof panels.

A further object of the present invention is to provide a support system in a grain bin roof which has a shiftable load point.

These and other more particular objects and advantages of the present invention are specifically set forth and will become apparent from the following detailed description of the preferred form of the invention when read in conjunction with the accompanying drawings, wherein.

Figure 1:
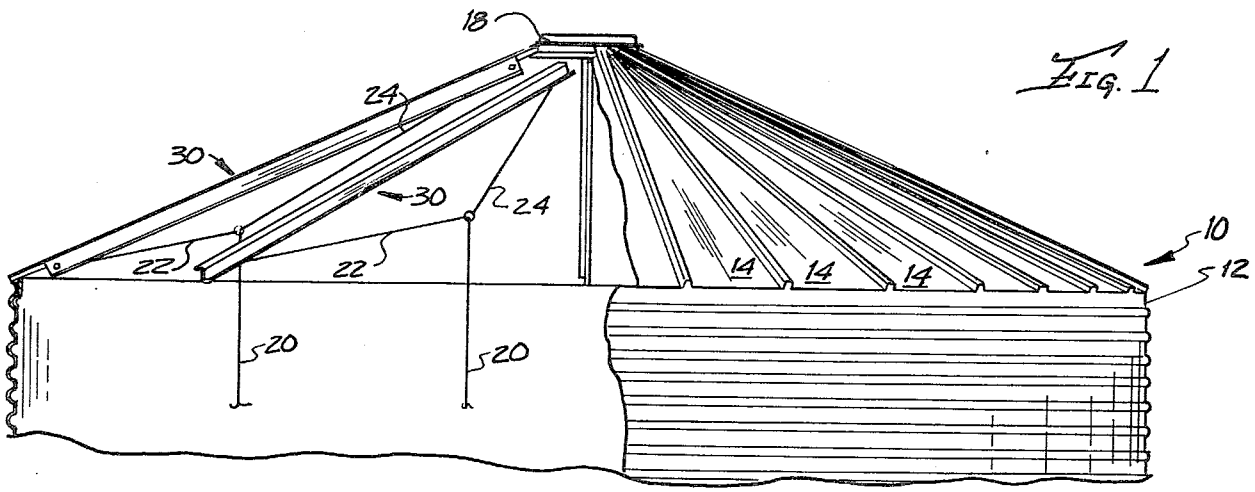
FIG. 1 is a side elevational view of a grain bin incorporating the present invention with portions of the wall and roof panels broken away.

Referring now to the drawings for a more detailed description of the invention, there is illustrated in FIG. 1 a circular grain storage bin generally designated by reference numeral 10. The side walls 12 of the bin are made up of corrugated sheets bolted together in a conventional manner well known in the grain bin art and therefore not described in detail. The roof of the bin 10 is made up of a plurality of tapered roof panels 14 anchored at their lower edge 43 to the bin wall 12, which is the primary support, and at their upper ends 42 to a center collar member 18 which is the secondary support. The roof panels, also called roof sheets, are all uniform and symmetric, having a u-shaped rib 38 located along both longitudinal edges of the panel 14. Each rib 38 is made up of a pair of diverging side walls 40, diverging from a web area 39. The ribs 38 of each adjacent panel overlap each other to form a rib of double thickness in conjunction with the stiffener members 30 hereafter described. Positioned at various spacings around the roof structure are a plurality of longitudinal stiffener members 30, three of which can be seen in the broken away section of FIG. 1. Stiffener 30 is z-shaped in cross section, having a vertically positioned web 32 with two oppositely extending flanges 34 and 35 at opposite ends thereof. Upper flange 34 is only wide enough to provide a mounting surface for attaching to the web area 39 of roof panel ribs 38. Lower flange 35 has substantially more width along with an upturned leg 36 at its outer end to provide a substantially greater moment of inertia against horizontal bending loads. Stiffener 30 is attached to the roof panel section 14 along its upper flange 34 by means of a plurality of bolts 46 through holes 41 in the roof panels. Attached at opposite ends of each stiffener member 30 are a pair of suspension cables 22 and 24, which join at a load supporting ring 71 which in turn supports a thermocouple cable 20. The thermocouple cables 20 extend downwardly into the grain bin at various heights, depending upon the particular layout of the bin, and are not described or shown in any detail since they are not a part of the invention. As can be seen in FIG. 1, the position of the thermocouple cable relative to the side wall can be varied depending upon the length of the cables 22 and 24. Cables 22 and 24 are anchored by bolts 46 in the lower end portions of the web 32 of the stiffener member.

Figure 2:
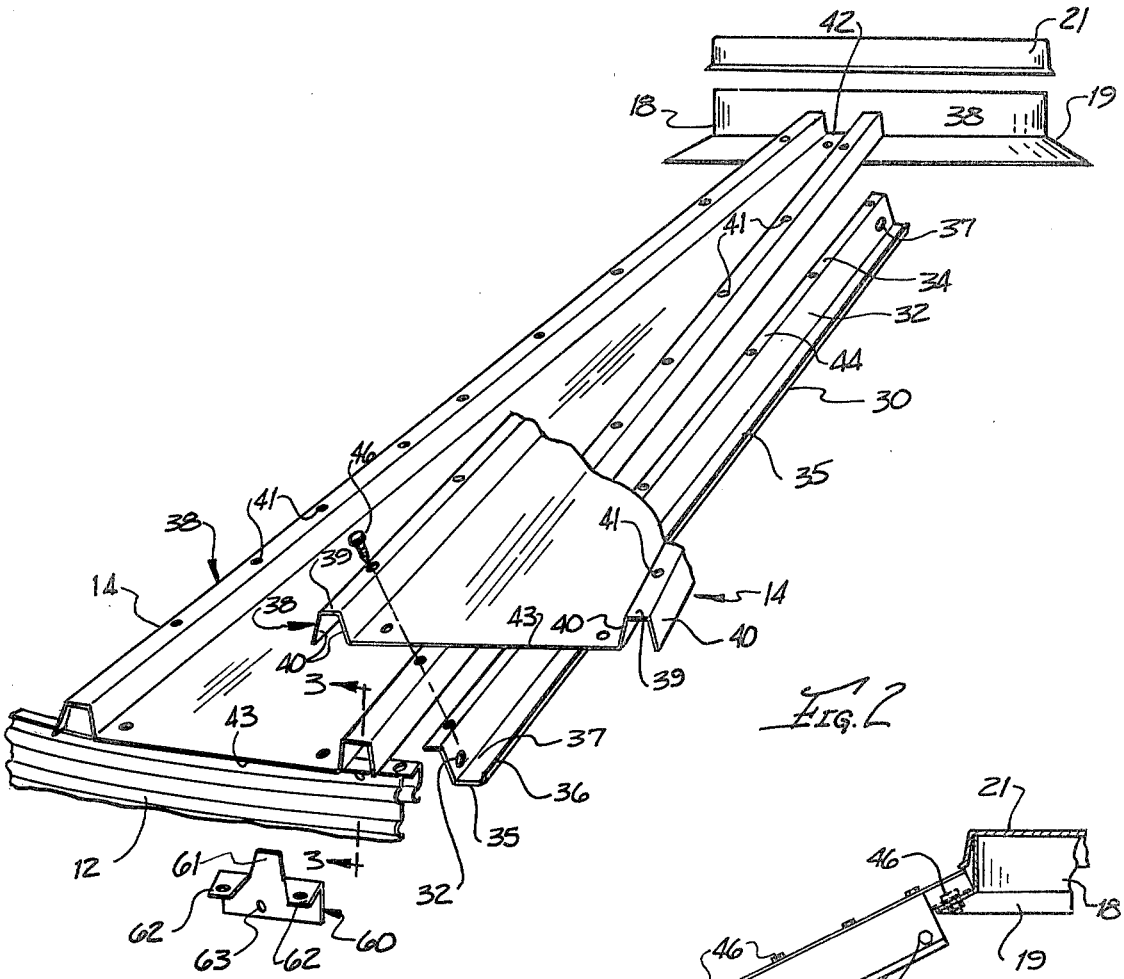
FIG. 2 is a perspective view partially exploded of adjacent roof panels and the associated structure.
Figure 3:
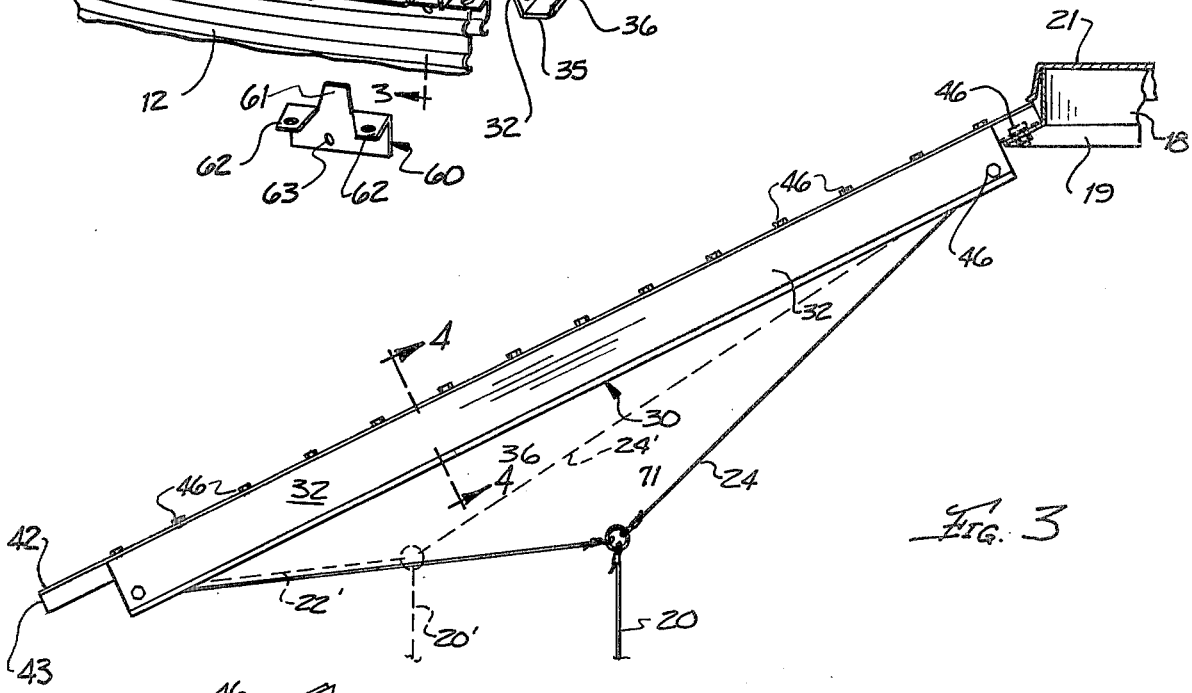
FIG. 3 is a radial sectional view through the roof illustrating the stiffener and its accompanying cables.
Figure 5:
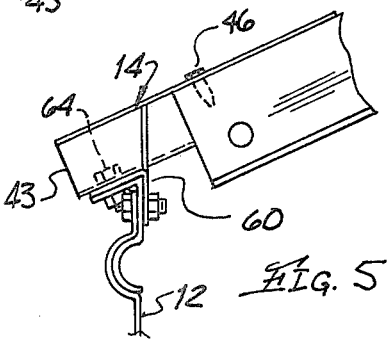
FIG. 5 is a partial sectional view taken along line 3—3 of FIG. 2 illustrating the details of the connecting structure between the roof and sidewalls.

The roof sheets 14 are attached to the bin wall 12 by means of a bracket 60, shown in FIGS. 2 and 3. Bracket 60 has an upwardly extending tab 61 which extends upwardly into each panel rib 38 so as to close that opening into the bin interior. Bracket 60 is bolted to panel 12 with a single bolt through opening 63 and is in turn bolted to two adjacent roof panels through a pair of holes 62 in the bracket. The upper end of roof panel 14 is bolted to the flange 19 of center collar 18. The upper end 42 of roof panel 14 abuts center collar 18 and is provided with a circular cap member 21 for purposes of sealing the center of the roof structure against the weather. The lower end 43 of the roof panel 14 slightly overhangs the side wall 12 of the bin.

The larger size grain bins provide additional connecting means for anchoring the stiffeners 30 directly to the grain bin wall and center collar while in the present configuration shown in FIG. 2, the stiffener 30 is only tied to the roof sheet 14. In these larger size bins, the stiffeners 30 require a longer span and heavier loads, and therefore the necessity of a heavier structure.

Figure 4:
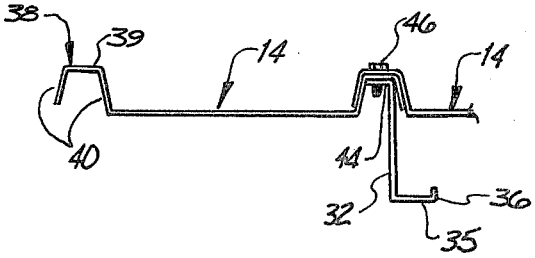
FIG. 4 is a partial sectional view taken along lines 4—4 of FIG. 2.

By varying the length of suspension cables 22 and 24, the position of thermocouple cable 20 can be varied from the side wall 12 without varying any other structure in the roof assembly. Due to the acute angle of the suspension cables with respect to the stiffener member, substantial compressive loads are transmitted to the stiffener member 30 tending to buckle the stiffener in a horizontal direction, as seen in FIG. 4, which is its weakest bending axis. Since the upper flange 34 of the stiffener 30 is integrally attached to the roof panels 14, the added moment of inertia from the overlapping roof panels gives the overall structure sufficient rigidity to support a wide range of thermocouple loads. An alternate location of the thermocouple cable 20' is shown in dotted line in FIG. 3.

Having described the invention with sufficient clarity that those skilled in the art may make and use it, what is claimed as new and desired to be secured by Letters Patent, is:

1. A conical roof assembly structure for grain bins required to support randomly positioned cable loads including:

a primary support in the form of a circular wall;

a secondary support in vertically spaced concentric relation to the primary support;

a plurality of tapered roof panels radially arranged, the longitudinal side edges of each roof panel being shaped in an inverted u-shaped rib, the u-shaped rib of each adjacent roof panel overlapping the rib of the adjacent panel, the upper ends of the roof panels being secured to the secondary support while the lower ends are secured to the primary support forming a conical structure;

a plurality of longitudinal stiffener members each having a web with an upper and lower flange extending from the opposite ends of the web, said stiffener members being radially spaced under the rib of one or more roof panels, the web of each stiffener member being vertically positioned and having a greater dimension than both upper and lower flanges;

fastening means along the ribs of the roof panels passing through the overlapping ribs of the adjacent roof panels and the upper flange of the stiffener member forming a rigid structure for support of bending and compression loads;

wherein the improvement comprises:

cable suspension means attached approximate each end of each stiffener member to a common load mounting point therebetween for supporting vertical cable loads whereby the tensile loads on the cable suspension means cause its associated stiffener member to act in compression.

2. A roof assembly structure as set forth in claim 1 wherein the lower flange of the stiffener member has a greater width than the upper flange so as to provide a greater bending moment in a horizontal plane.

3. A roof assembly structure as set forth in claim 1 wherein the lower flange of the stiffener member has a greater width than the upper flange including an upwardly turned edge so as to provide an increased bending moment in a horizontal plane.

4. A roof assembly structure as set forth in claim 1 wherein the u-shaped rib of each roof panel includes a web area and two diverging side walls; the upper flange of the stiffener member being received inside the rib in flush side-by-side relationship with the web area; the fastening means comprising a plurality of bolts extending the length of the rib passing through the web areas of the ribs and the upper flange of the stiffener member so as to provide a rigid structure.

5. A roof assembly structure as set forth in claim 1, wherein the u-shaped rib of each roof panel includes a web area and two diverging side walls; the upper flange of the stiffener member being received inside the rib in flush side-by-side relationship with the web area; the fastening means comprising a plurality of bolts extending the length of the rib passing through the web areas of the ribs and the upper flange of the stiffener member so as to provide a more rigid structure to bending and compression loads.

6. A conical roof assembly structure for grain bins required to support randomly positioned cable loads including:

a primary support;

a secondary support in vertically spaced concentric relation to the primary support;

a plurality of tapered roof panels radially arranged, the longitudinal side edges of each roof panel being shaped in an inverted u-shaped rib, the u-shaped rib of each adjacent roof panel overlapping the rib of the adjacent panel, the upper ends of the roof panels being secured to the secondary support while the lower ends are secured to the primary support forming a conical structure;

a plurality of longitudinal stiffener members each having a web and two flanges, said stiffener members being radially spaced under the rib of one or more roof panels, the web of each stiffener member being vertically positioned with the upper flange horizontally positioned inside the roof panel rib;

fastening means along the ribs of the roof panels passing through the overlapping ribs of the adjacent roof panels and the upper flange of the stiffener member, wherein the improvement comprises: cable suspension means attached approximate the end of each stiffener member with a load mounting point therebetween for supporting vertical cable loads.

7. A roof assembly structure as set forth in claim 6 wherein the lower flange of the stiffener member has a greater moment of inertia than the upper flange.

8. A roof assembly structure as set forth in claim 6 wherein the lower flange of the stiffener member has a greater moment of inertia along a horizontal plane than the upper flange.

9. A roof assembly structure as set forth in claim 6 wherein ends of the stiffener members are anchored to the primary and secondary supports and the upper and lower ends of the roof panels are secured to the secondary and primary supports respectively, through the stiffener members.

10. A roof assembly structure as set forth in claim 6 wherein the load mounting point on the cable suspension means is movable.

11. A roof assembly structure as set forth in claim 6 wherein the load mounting point on the cable suspension means is movable and the angle between the stiffener member and the cable suspension means at each end is less than 45°.

* * * * *